US007178789B1

(12) United States Patent
Lehmann

(10) Patent No.: US 7,178,789 B1
(45) Date of Patent: Feb. 20, 2007

(54) FIXTURE FOR HANGING WIRE FENCE

(76) Inventor: Ryan P. Lehmann, 2895 Wimbeldon La., Lancaster, PA (US) 17601

( * ) Notice: Subject to any disclaimer, the term of this patent is extended or adjusted under 35 U.S.C. 154(b) by 5 days.

(21) Appl. No.: 10/995,720

(22) Filed: Nov. 22, 2004

Related U.S. Application Data

(60) Provisional application No. 60/533,612, filed on Dec. 31, 2003.

(51) Int. Cl.
*E04H 17/12* (2006.01)

(52) U.S. Cl. ..... 256/47; 256/48; 256/24

(58) Field of Classification Search ..... 256/2, 256/6, 7, 10, 32, 47, 49, 50–52
See application file for complete search history.

(56) References Cited

U.S. PATENT DOCUMENTS

| | | | | |
|---|---|---|---|---|
| 957,619 | A | 5/1910 | Melish et al. | |
| 3,233,870 | A | 2/1966 | Gerhardt | |
| 3,572,639 | A * | 3/1971 | Shettel | 256/10 |
| 3,698,691 | A * | 10/1972 | Brown | 256/11 |
| 3,749,368 | A * | 7/1973 | Miller | 256/11 |
| 4,093,187 | A * | 6/1978 | Robinson | 256/49 |
| 4,465,263 | A * | 8/1984 | Robbins, Jr. | 256/52 |
| 4,598,523 | A * | 7/1986 | Tolliver | 52/685 |
| RE32,707 | E | 7/1988 | Robbins, Jr. | |
| 4,771,137 | A * | 9/1988 | Thompson | 174/163 F |
| 5,063,274 | A * | 11/1991 | Johnson | 174/158 F |
| 5,425,518 | A * | 6/1995 | Czerniak | 248/67.5 |
| 5,899,041 | A * | 5/1999 | Durin | 52/660 |
| 6,082,690 | A * | 7/2000 | Durin et al. | 248/241 |
| 6,489,569 | B1 * | 12/2002 | Thomson | 174/154 |
| 6,590,154 | B1 * | 7/2003 | Badey et al. | 174/48 |
| 6,872,892 | B1 * | 3/2005 | Burdick | 174/158 F |
| 6,880,811 | B2 * | 4/2005 | Burdick | 256/10 |

* cited by examiner

*Primary Examiner*—Daniel P. Stodola
*Assistant Examiner*—Joshua T. Kennedy
(74) *Attorney, Agent, or Firm*—McNees Wallace & Nurick LLC

(57) ABSTRACT

The apparatus is a fixture for mounting wire fence on posts. The apparatus is a channel formed with slots across the web of the channel and the slots angled into the channel walls to form finger like tabs. Holes in lengthwise flanges on the channel sides or holes in the web permit mounting the fixture on a post using screws. The channel can be constructed in long or relatively short sections. The hanging fixture can be used at the top and bottom of the wire fence with the angles of the slots reversed, so that the wire fence can be trapped between them after simple installation by merely bending the wires to fit them into the slots.

7 Claims, 3 Drawing Sheets

FIXTURE FOR HANGING WIRE FENCE

BACKGROUND OF THE INVENTION

This application is based upon U.S. Provisional Patent Application Ser. No. 60/533,612 filed Dec. 31, 2003.

This invention deals generally with fences and more specifically with a fixture for hanging wire fences on posts.

Probably the most common system for hanging wire fence on wooden fence posts is the use of simple metal staples. However, although the staples are inexpensive, the drawbacks frequently encountered are their tendency to deteriorate with time and exposure and the possibility they will loosen due to deterioration of the straight holes in the wooden post by which they are attached.

Another common system for supporting wire fences uses a metal post that is shaped generally like a channel and has angled slots or tabs on the channel's web over the entire length. This permits hanging the fence wires within such slots or between the tab and the body of the post. On the posts with tabs, the tabs can be bent in toward the body after the fence is installed to lock the fence wire in place. Such metal posts are, of course, much more expensive that simple wood posts, not only because of the material cost, but also due to the need to form the channel and the tabs over the entire length of the post so that it can be used for any height of fence. Another extra cost arises when such posts are being used for electrified fences. In that situation the electrified wire must be mounted on individual insulators at each post. A less obvious limitation of such slotted metal posts is that all the slots are parallel and must be angled with their opening at the highest point of the slot to permit hanging the fence wires. However, while that means that all the fence wires can be placed in the slots with a single downward motion, it also means that an upward force will detail the entire fence from the post unless the wires are somehow locked in place.

It would be very beneficial to have a wire fence hanging fixture that can be used on all types of fence posts, is suitable for all fence heights, is inexpensive to manufacture, and can easily lock a wire grid fence in place without any other parts.

SUMMARY OF THE INVENTION

The present invention is a fence hanging fixture for both individual wires and grid pattern wire fences. The basic structure of the fence hanging fixture is that of a box beam or channel with a transverse angled slot formed across the web of the channel and part way into the walls to form a tongue like tab essentially parallel to the web of the channel. Holes formed in the web and spaced from the tab accept screws or other fasteners that are used to attach the hanging fixture to a post.

In the preferred embodiment of the fixture, the tab is formed with varying thicknesses, and the part of the tab nearest to the web is thicker so that the slot is narrower near the web and wider as it progresses farther down the channel walls. This change of dimension of the slot acts as a retainer for wires pushed down into the slot.

The hanging fixture is of modular construction. That is, when the hanging fixture is made in lengths with multiple slots, the pattern regularly repeats itself, and can therefore be cut into smaller lengths if desired for more economical use. However, a fixture with a four inch pattern repeat three times makes the fixture usable with many standard fence grid patterns without cutting.

A particularly interesting use of the hanging fixture is to use one or more modules at the top of a fence with the slots opening upward, and one or more modules at the bottom of the fence with the slots opening downward. This arrangement locks the fence in place once the wires are installed in the slots, because neither upward nor downward forces can move the wires out of their slots.

When the fixture is molded of plastic the invention furnishes a simple and inexpensive wire and fence hanging fixture that can be attached to posts of virtually any material, and it will not deteriorate with age or exposure to the weather.

DETAILED DESCRIPTION OF THE INVENTION

Figure 1:
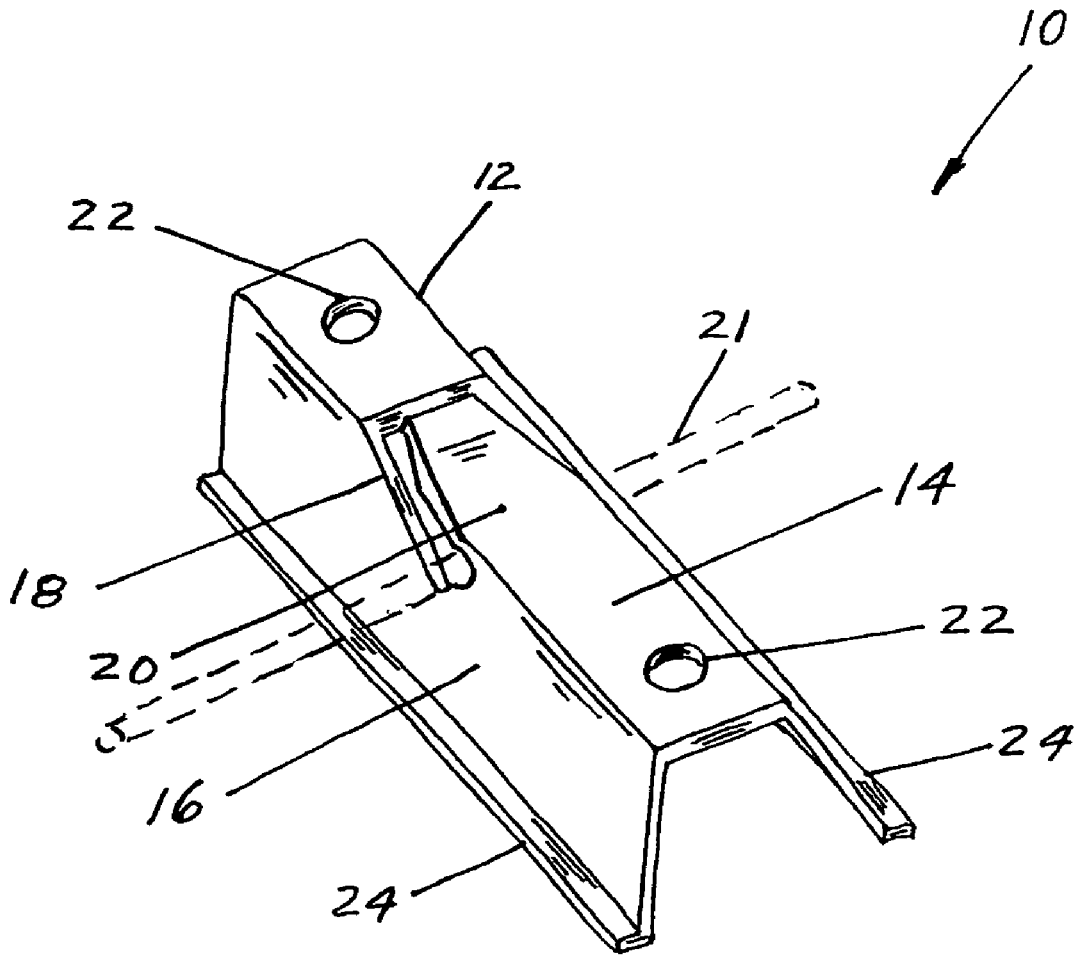
FIG. 1 is a perspective view of the preferred embodiment of the hanging fixture of the invention.

FIG. 1 is a perspective view of the preferred embodiment of hanging fixture 10 of the invention with gripping tab 20 for a single wire. Hanging fixture 10 includes body 12 constructed as a channel with a trapezoidal cross section and with web 14 and two side walls 16. Slot 18 is formed in web 14 and in the portion of side walls 16 nearest to web 14 to form tongue like tab 20 extending in a substantially longitudinal direction along the body 12. Mounting holes 22 are used for fasteners to attach hanging fixture 10 to a fence post, and fence wire 21 slipped into slot 18. Fence wire 21 is held spaced away from the fence post by slot 18 as tab 20 holds the fence wire within slot 18. Short flanges 24 provide extra stability for hanging fixture 10 when it is held on a fence post.

The preferred embodiment of the invention shown in FIG. 1 is 3 inches long, 1½ inches wide and ¾ inch tall, with slot 18 approximately centered on the length and extending to 0.3 inch below the outer surface of the web. Tab 20 is 0.7 inch long.

Figure 2:
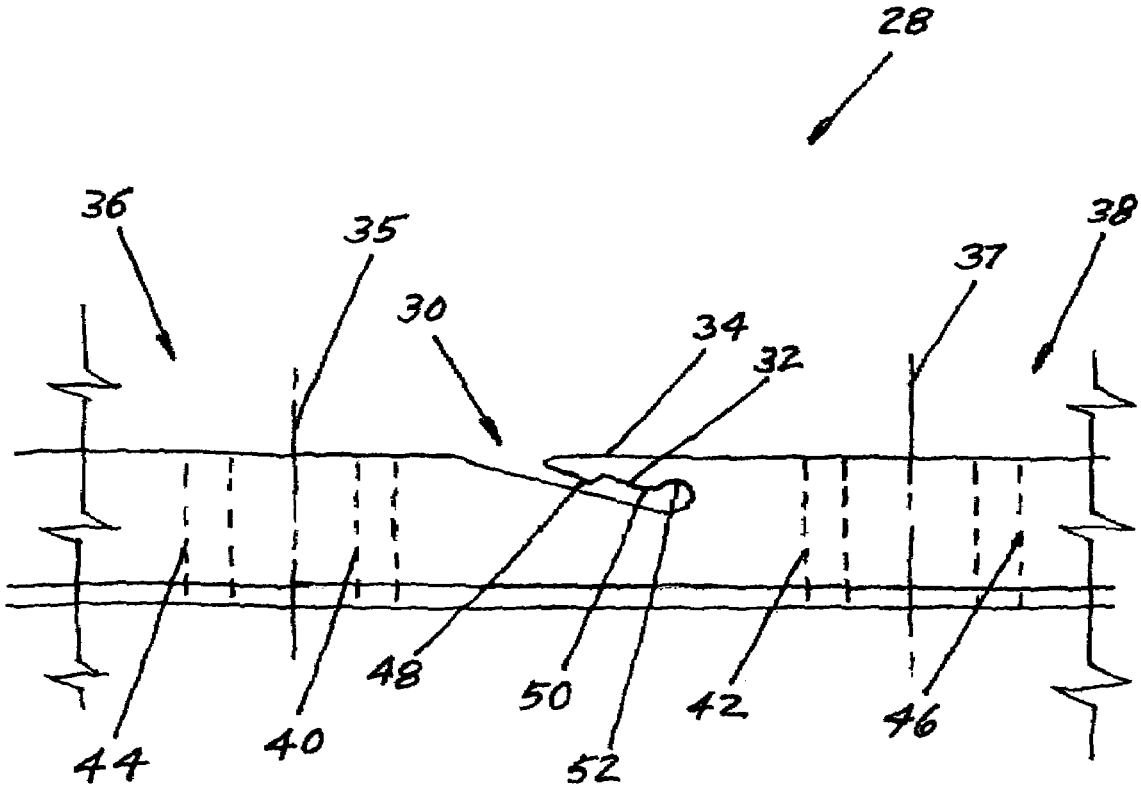
FIG. 2 is a side view of one wire capturing slot of the invention shown with parts of adjacent repeat patterns.

FIG. 2 is a side view of hanging fixture 28 with wire capturing slot 30 and shows a better view of surface 32 under tab 34. FIG. 2 also show parts of adjacent repeat modular slot patterns 36 and 38 located beyond imaginary pattern dividing lines 35 and 37. Mounting holes 40 and 42 associated with slot 30 are shown with dashed lines along with mounting holes 44 and 46 of adjacent slot patterns 36 and 38.

FIG. 2 clearly shows the ridged construction of surface 32 under tab 34. Such a ridged surface is used to adapt slot 30 to grip several sizes of fence wire. Slot 30 extends at an angle to the plane of the web along body 12. As can be seen in FIG. 2, the ridged surface creates narrower portions of slot 30 to prevent fence wires from moving out of slot 30. Ridge peak 48 provides the smallest clearance within slot 30 to capture smaller wires, and ridge peak 50 and valley 52 provide for larger fence wires. Also, when the hanging fixture is constructed of a flexible material such as PVC, its tab flexes to admit larger wires and hold them tightly within the slot. Tab 34 also includes an upper surface of the tab being substantially coplanar to a surface of the fixture body 12.

Figure 3:
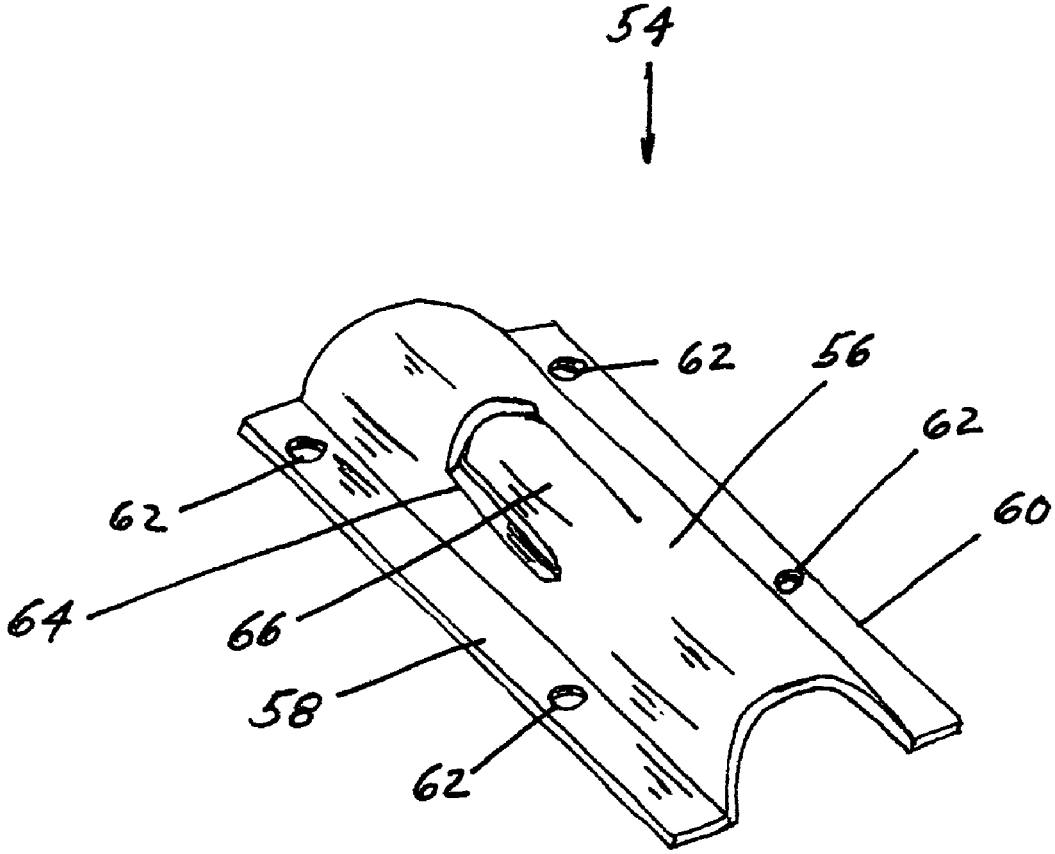
FIG. 3 is a perspective view of an alternate embodiment of the invention in which the channel has a curved shape and flanges are formed on the channel that include holes for mounting the hanging fixture.

FIG. 3 is a perspective view of an alternate embodiment of hanging fixture 54 of the invention in which channel 56 has a curved shape and wider flanges 58 and 60 are formed at the base of channel 58 and include holes 62 for mounting hanging fixture 54 on a fence post. Hanging fixture 54 has slot 64 and tab 66 and therefore functions in the same manner as hanging fixture 10 of FIG. 1.

As indicated by FIGS. 1 and 3, many configurations can be use for the fixture of the invention. The fixture cross section can be square, rectangular, semicircular, and virtually any other shape. The basic requirements for the fixture are that it have a fastening device by which to attach it to a fence post, a spacing structure that spaces a fence wire away from the fence post to which the fixture is fastened, and a capture structure to hold a wire on the spacing structure. In the preferred embodiment of FIG. 1 holes 22 are the fastening devices by which the fixture is attached to the fence post, channel sides 16 act as the spacing structure, and slot 18 and tab 20 function together as a capture structure to hold the fence wire on the spacing structure of sides 16.

A particularly interesting use of the hanging fixture of the invention is to use one or more hanging fixtures at the top of a fence with the slots opening upward, and one or more hanging fixtures at the bottom of the fence with the slots opening downward. This arrangement locks the fence in place once the wires are installed in the slots, because neither upward nor downward forces can move the wires out of their slots.

The original installation of such an arrangement can be accomplished by two methods. One way is to install the upper fixtures first, then hang the fence on them, and fasten down the lower hanging fixtures after the wires have been inserted within them. The other method is to simply bend the fence wires to insert them into previously hung fixtures and reshape the wires as they are inserted into the slots of the fixtures.

The present invention thereby yields a convenient and inexpensive apparatus for mounting wire fences and individual wires on virtually any type of fence post into which a fastener can be driven. Furthermore, since the preferred material for the hanging fixtures of the invention is some sort of plastic, the fixtures furnish inherent insulation when used for electrified fences.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For example, various shapes, dimensions, and materials can be used for the hanging fixture of the invention.

What is claimed as new and for which Letters patent of the United States are desired to be secured is:

1. A hanging fixture for holding wire fencing on a fence post comprising:

a fixture body;

at least one fastening device on the fixture body by which the fixture body is fastened to a fence post;

at least one spacing structure formed into the fixture body to hold a fence wire away from a fence post to which the fixture body is attached; and at least one wire capture structure formed into the fixture body to hold a wire on the spacing structure;

wherein the fixture body is shaped as a channel with a web and two sides, each side with one edge attached to the web, the capture structure includes a slot formed transversely across the web that penetrates into both sides at an angle to the plane of the web and thus forms a tab in the web that holds a wire within the slot, and the underside of the tab has a ridged surface; and wherein the fixture body has at least two side edges, a flange is attached to each side edge, and the fastening device is includes at least one hole in each flange through which a fastener can be inserted to attach the hanging fixture to a fence post.

2. The hanging fixture of claim 1, wherein the ridged surface comprises a plurality of ridges to hold a plurality of sizes of wire.

3. The hanging fixture of claim 1, wherein the tab extends in a longitudinal direction along the fixture body.

4. The hanging fixture of claim 1, wherein an upper surface of the tab is coplanar to a surface of the fixture body.

5. A hanging fixture for holding wire fencing on a fence post comprising:

a fixture body;

at least one fastening device on the fixture body by which the fixture body is fastened to a fence post;

at least one spacing structure formed into the fixture body to hold a fence wire away from a fence post to which the fixture body is attached; and at least one wire capture structure formed into the fixture body to hold a wire on the spacing structure;

wherein the fixture body is shaped as a channel with a web and two sides, each side with one edge attached to the web, the capture structure includes a slot formed transversely across the web that penetrates into both sides at an angle to the plane of the web and thus forms a tab in the web that holds a wire within the slot, and the underside of the tab has a ridged surface; and wherein the fixture body is shaped as a partial circular cylinder.

6. The hanging fixture of claim 5, wherein the ridged surface comprises a plurality of ridges to hold a plurality of sizes of wire.

7. The hanging fixture of claim 5, wherein the tab extends in a longitudinal direction along the fixture body.

* * * * *